US005751215A

United States Patent [19]

Hall, Jr.

[11] Patent Number: 5,751,215

[45] Date of Patent: May 12, 1998

[54] FIRE FINDING APPARATUS

[76] Inventor: Joseph F. Hall, Jr., 22971 Triton Way Unit B, Laguna Hills, Calif. 92653

[21] Appl. No.: 752,846

[22] Filed: Nov. 21, 1996

[51] Int. Cl.[6] ..... G08B 17/00

[52] U.S. Cl. ..... 340/584; 340/620; 340/514; 340/693; 374/121; 374/131; 374/141; 374/170; 219/502

[58] Field of Search ..... 340/584, 555, 340/600, 514, 693; 364/525, 557; 374/121, 124, 127, 125, 131, 141, 142, 170; 250/351; 219/502

[56] References Cited

U.S. PATENT DOCUMENTS

| | | | |
|---|---|---|---|
| 3,017,513 | 1/1962 | Messelt | 250/83.3 |
| 3,555,243 | 1/1971 | Roman | 219/502 |
| 3,597,755 | 8/1971 | Parkin | 340/555 |
| 3,761,713 | 9/1973 | Merrill | 250/341 |
| 3,943,499 | 3/1976 | Dunphy | 340/514 |
| 3,993,138 | 11/1976 | Stevens et al. | 340/515 |
| 4,494,881 | 1/1985 | Everest | 374/124 |
| 4,634,294 | 1/1987 | Christol et al. | 374/170 |
| 5,045,839 | 9/1991 | Ellis et al. | 340/531 |
| 5,283,549 | 2/1994 | Mehaffey et al. | 340/521 |
| 5,352,039 | 10/1994 | Barral et al. | 374/121 |
| 5,422,484 | 6/1995 | Brogi et al. | 250/339.15 |

OTHER PUBLICATIONS

Fire Finder II, Model 955 Dyn–Optics Infrared heat sensor.

*Primary Examiner*—Jeffery Hofsass
*Assistant Examiner*—Benjamin C. Lee
*Attorney, Agent, or Firm*—Gene Scott-Patent Law & Venture Group

[57] ABSTRACT

An infrared sensor is particularly well suited for the detection of heat sources, specifically from fires. It comprises an infrared detector receiving infrared radiation from a focused refractive optical unit. An optical chopper and electronic amplifier enable the sensor to operate without drift and with immunity to temperature changes in the sensor itself. The infrared radiation from the optical unit is appropriately filtered so as to optimize reception in a frequency band between 2.6 and 2.8 microns. In this band, there exists negligible energy from the sun due to absorption by gas molecules in the earth's atmosphere. Consequently, the sensor can be used in full sunlight without becoming saturated by the large magnitude infrared radiation of the sun. The sensor contains circuitry providing an audible output signal whose pitch is proportional to the intensity of the infrared radiation received from nearby heat sources. The device does not require any visual attention from a firefighter. The detector is housed in a cylindrical case appropriate for manipulation by a heavily gloved hand of the firefighter. A self-test feature operates briefly when the sensor is first turned on to assure the user that the sensor is fully operational. A "downed firefighter" feature sounds an alarm in the event that the firefighter becomes immobile.

4 Claims, 2 Drawing Sheets

FIRE FINDING APPARATUS

BACKGROUND OF THE INVENTION

1. Field of the Invention

The present invention relates to an infrared sensor capable of detecting heat sources typically associated with fire in a burning building as well as in the out-of-doors when sunlight is present.

2. Description of Related Art

The following art defines the present state of this field:

Brogi et al., U.S. Pat. No. 5,422,484 describes an infrared detector well suited for the detection of heat sources, especially from fires in an outdoor environment. The detector may be housed in a hermetically sealed unit appropriate for outdoor use and mounted on a movable pedestal for inclusion in an overall fire protection system such as a forest fire detection and warning system.

Barral et al., U.S. Pat. No. 5,352,039 describes a remote temperature difference measuring device which includes a measuring circuit having a heat flux detector for sensing the heat flow from an area on the surface of the body, and a portable housing which supports the sensor and also a device for determining or marking the area of analysis. The device is especially suited for measuring the temperature on the surface of a human or animal body.

Christol et al., U.S. Pat. No. 4,634,294 describes a handheld instrument for measuring the temperature of a target without contact with the target. The instrument utilizes a microprocessor and a digital display to calculate and indicate different temperature functions. Compensation is included for the effects of emissivity and ambient temperature changes which otherwise could result in inaccurate readings. Temperature trend direction liquid crystal arrow(s) actuated by the microprocessor are included in the display.

Everest, U.S. Pat. No. 4,494,881 describes a sighting system primarily for use with infrared thermometers and that provides a visible light beam, the geometry of which is congruent with the field of view of the infrared optics of the thermometer to provide the user with an accurate representation of the intersection of the field of view cross-section of the object of which the temperature is being measured by the thermometer. Two novel embodiments are disclosed, one which utilizes Fresnel lenses and one of which utilizes a Cassegrainian lens system. Both embodiments provide means for accommodating an isolated visible light source and passage of the visible light generated therefrom through the identical lens system used by the infrared detector to develop the signal indicative of the infrared energy and therefore temperature generated by the object to which the infrared thermometer is directed.

Merrill, U.S. Pat. No. 3,761,713 describes a method of detecting loose rock in excavated passages through subterranean structures by an analysis of thermal conditions at the surfaces of said passages measured with infrared responsive instruments.

Messelt, U.S. Pat. No. 3,017,513 describes a portable, infrared fire detection apparatus that provides an apparatus sensitive to infrared radiation, has a self-contained power supply, is portable and easy to handle by one man, is fast acting and reliable, and is rugged and adaptable to operation under severe condition.

Dyn-Optics of Laguna Hills, Calif. produces a device called Fire Finder II, Model 955, that is used for locating fire or hot spots both within buildings, as well as outside of buildings, while exposed to direct sunlight or sunlit surfaces.

The Fire Finder II produces an audible alarm to indicate that it is directed toward a heat source. The pitch of the alarm is proportional to the size and temperature of the heated area. A firefighter can locate the hottest portion of a fire even through dense smoke and window glazing, and in bright sunlight by moving the device until the highest pitch of the alarm is produced. The firefighter is now able to direct his fire extinguishing equipment in the direction of the heart of the fire for best efficiency in knocking down the fire with the least water damage to the surrounding area. The threshold sensitivity of the Fire Finder II is adjusted to detect and signal an alarm for a heat source above approximately 200° F.

The prior art teaches the detection of heat in fire related applications. However, the prior art does not teach a device with self testing capability, nor does it teach a device that eliminates zero drift from the detector, and which provides input filtering so as to operate over a spectral radiation energy band where atmospheric absorption reduces the solar radiation to essentially zero so that the sensor is able to operate in full sunlight. Furthermore, the prior art does not disclose alarm circuitry for a downed firefighter situation. The present invention fulfills these needs and provides further related advantages as described in the following summary.

SUMMARY OF THE INVENTION

The present invention is an infrared fire sensor which is particularly well suited for the detection of heat sources in the natural environment or in burning structures. It is generally intended for use in burning buildings, but is applicable for outdoor fires such as in forests, backyards, storage yards, and other applications. Other applications which are envisioned are those of hangar and air strip surveillance at airports as well as the monitoring of urban refuse depots, etc. Since the sensor is particularly well suited for fire detection outdoors, it is envisioned that the sensor would find optimal use as a detection component in an integrated forest fire surveillance system.

The infrared detector of the present invention optimally detects heat sources in the infrared frequency band falling within about 2.6 to 2.8 microns. It is within this band that the infrared radiation due to wood fires is at its maximum, and therefore false fire alarms possibly triggered by solar reflections or thermal fluctuations of the ambient background temperature are minimized. This is especially true since solar energy transmission, through the earth's atmosphere, in this band is essentially zero.

The sensor is made up of an infrared detector which receives infrared radiation collected and focused by a refractive optical collection unit. Between the infrared detector and the optical collection unit is a spectral filter having a pass band which is selected so as to optimize infrared detection of the system within a frequency band of between about 2.6 to 2.8 microns. The desired frequency band is obtainable through a suitable combination of materials which make up the optical collection unit, the spectral filter and the infrared response curve of the infrared detector itself.

Suitable electronics are provided to provide bias current to the infrared detector, if such detector is, for example, of a photoconductive variety, and an amplifier is provided to amplify the signal coming from the infrared detector to suitable levels for use in the instant device.

The infrared detector used in the system may be implemented either as a photovoltaic or photoconductive detector comprised of a single sensing element or it may be made up of a multiplicity of detector elements arranged in a linear matrix. By arranging individual detector elements in a linear matrix, the overall field of view of the detector may be varied. For example, if each single detector element has a field of view of one degree, then to achieve a field of view of 15° to 20° the matrix would require 15 to 20 elements. Of course, the focal lengths of the optics would vary accordingly so as to insure correct collection and focusing of infrared radiation for the field of view selected.

The individual detector elements may be chosen from presently available materials such as InSb, InAs, PbSe and HgCdTe. By utilizing these materials, and given the amounts of radiation expected to strike the detector for the types of radiation to be detected, the detector can be non-cooled. The material chosen for the individual elements of the infrared radiation detector, due to the variations of bandwidth sensitivity among the materials, requires appropriate variation of the optics and of the pass band of the filter so as to maintain the overall detector sensitivity within the 2.6 to 2.8 micron wavelength band.

It is therefore an object of the invention to provide an infrared sensor particularly well suited for the detection of fires in an indoor or outdoor environment. It is also an object of the invention to provide an infrared detector with a band width sensitivity within about 2.6 to 2.8 microns so as to optimize the detection of infrared radiation generated by wood fires while minimizing detection of variations due to solar radiation reflections or thermal fluctuations in the ambient background temperature within the field of view of the sensor, thereby minimizing false alarms.

Other objects and features of the present invention will become apparent from the following detailed description considered in conjunction with the accompanying drawings. It is to be understood, however, that the drawings are presented solely for purposes of illustration and not as a definition of the limits of the invention, for which reference should be made to the appended claims.

BRIEF DESCRIPTION OF THE DRAWING

The accompanying drawings illustrate the present invention. In such drawings.

DETAILED DESCRIPTION OF THE PREFERRED EMBODIMENT

Figure 1:
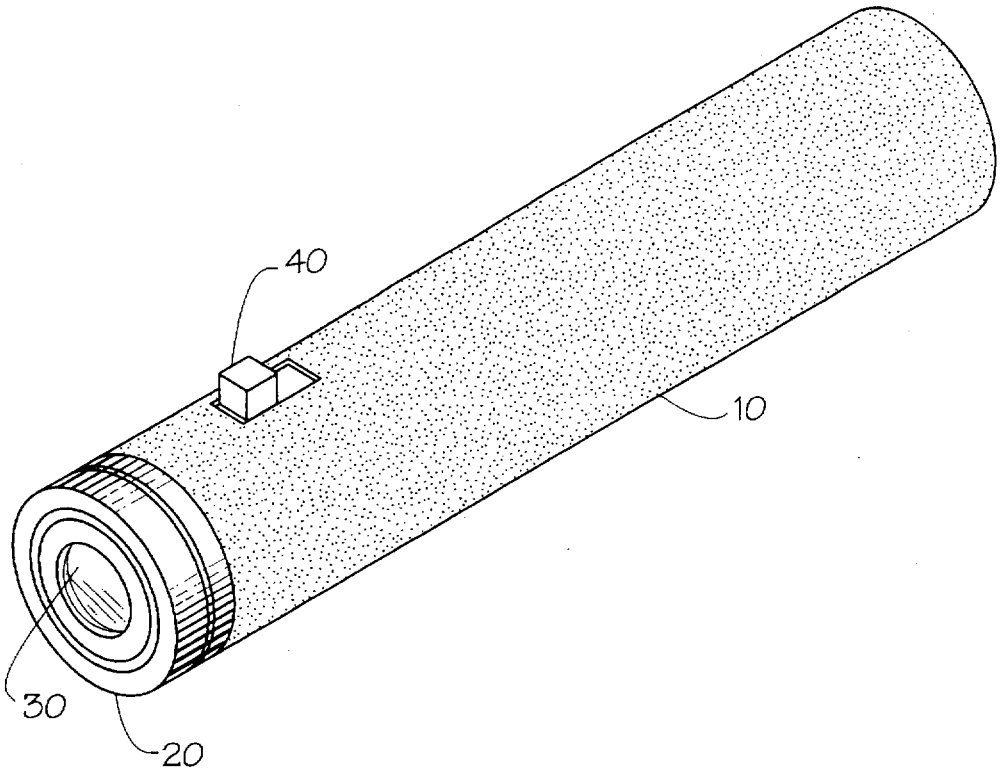
FIG. 1 is an isometric view of the present invention illustrating the preferred enclosing case for encompassing the invention.
Figure 2:
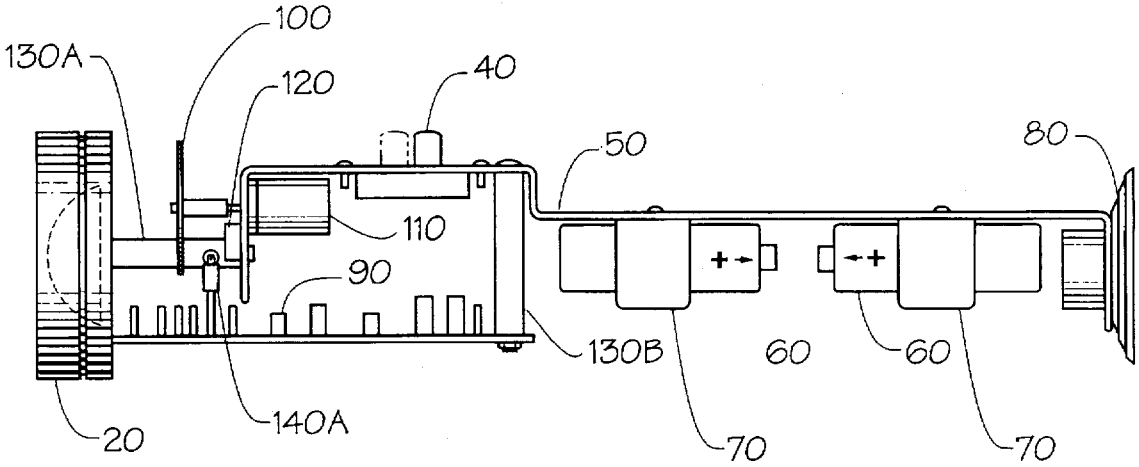
FIG. 2 is a side elevational view thereof shown without the enclosing case so as to illustrate the interior details of the invention.

The above described drawing figures illustrate the invention, a device for signaling the intensity of heat at selected spots in a burning environment such as in a building. The device as shown in FIG. 1 includes an optical collection means 30 mounted in a lens housing 20. Preferably the collection means 30 is an optical lens system as shown, for collecting and focusing an electromagnetic radiation signal emitted within the field of view of the device. The optical collection means 30 focuses the signal and emits a focused electromagnetic radiation signal within the case 10 of the device. An operation mode switch 40 is mounted on the case 10 for setting the device into operation.

Figure 3A:
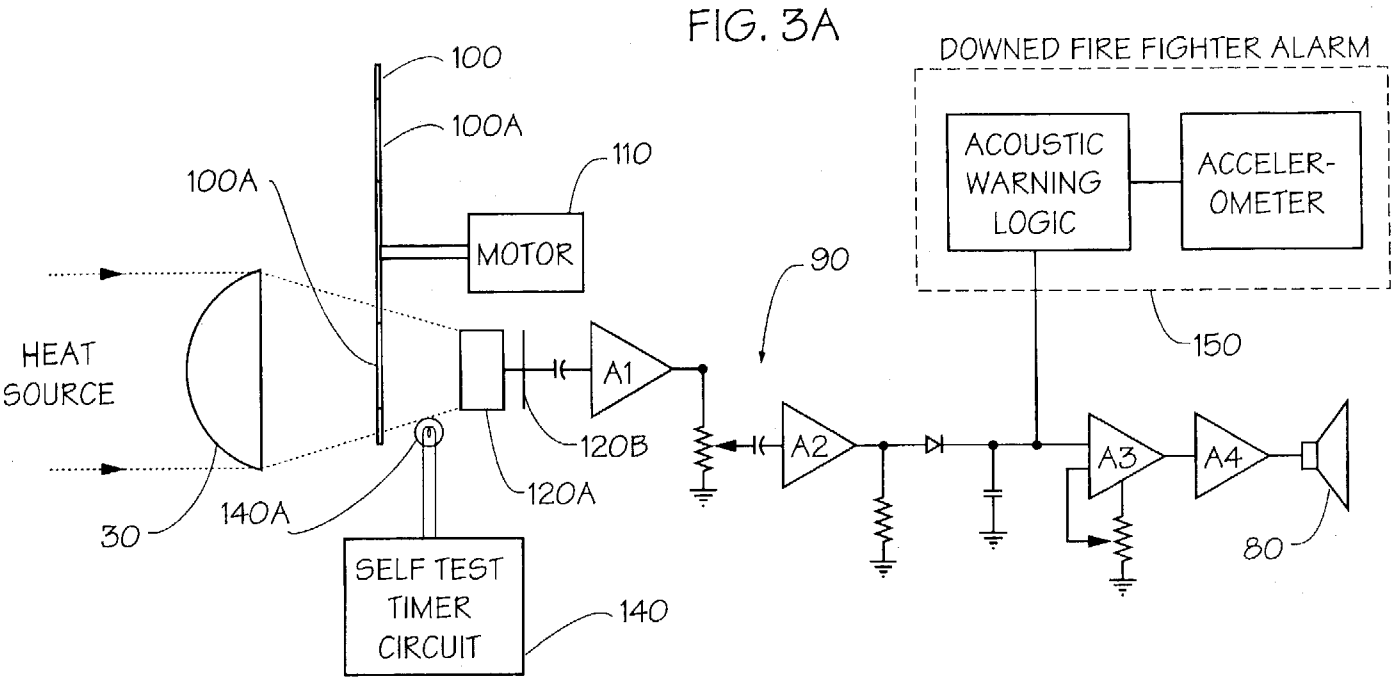
FIG. 3A is a schematic block diagram of the preferred embodiment of the present invention.

As detailed in FIG. 3A, a spectral filter means 120A receives the focused electromagnetic radiation signal emitted by the optical collection means 30 and blocks substantially all electromagnetic radiation having wavelengths shorter than about 2.6 microns and longer than about 2.8 microns. It is considered an inventive step in the present invention to have discovered and provided such a filter means. The prior art teaches that the filter means should pass between 2.5 and 5 microns wavelength energy. However, it has been discovered that significant spectral energy exists between 2.5 and 2.6 microns, and between 2.8 and 5 microns. In this respect, a device such as the present invention which must process a signal based upon energy received in the 2.5 through 5 micron range would require discrimination circuitry considerably more complex then in the present approach of 2.6 to 2.8 micron range. Thus the present approach has considerable advantage over the prior art, is simpler, less expensive to produce and provides a more trouble free operation with fewer false alarms. Although it is more difficult to produce the narrow band pass filter of the present invention, it has been discovered that this pass band of 2.6 to 2.8 microns contains almost no solar spectral energy, and is therefore highly advantageous in the use of the instant device when operating in daylight. The instant device is almost totally blind to atmospheric solar energy. The spectral filter means 120A emits a filtered electromagnetic radiation signal to an infrared detector means 120B of any common type, which, in turn, produces a corresponding electrical detector signal to an operational electrical circuit means 90, preferably, as shown in FIG. 3A. This circuit means 90 receives and amplifies the detector signal and further, provides an audible tone. The pitch or frequency of the audible tone is proportional to the magnitude of the detector signal. Therefore, with a little practice, a firefighter is able to determine how hot a surface in a building is, merely by listening to the pitch of the emitted tone. Referring to FIG. 3A, A1 depicts a pre-amplification circuit stage with a gain adjust potentiometer. This is interconnected with A2, an amplification circuit stage. Following A2 is an AC to DC converter interconnected to A3, a voltage to frequency converter with a threshold adjust potentiometer circuit stage, and this is followed by A4, an audio amplification circuit stage with a loudspeaker 80. The various circuit stages of the preferred embodiment are well known circuit elements and arrangements in the field of electrical engineering, and are, not in themselves novel matter in the present application, however, the arrangement of the various elements and the manner in which they work is considered to be novel and advantageously employed to achieve the above described objectives of the present invention.

Figure 3B:
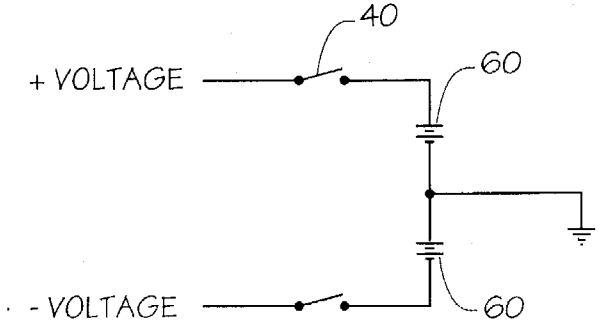
FIG. 3B is a schematic diagram of the power supply thereof.

Preferably, the circuit means 90 includes a means for repetitively interrupting 100 of the focused electromagnetic radiation signal emitted by the optical collection means 30. The interrupting means 100 provides a repetitive interruption to establish a zero base for the focused electromagnetic radiation signal so as to overcome the problem of zero drift in the device. The interrupting means 100 is preferably a rotating chopper wheel with holes 100A in it as is known in the art. The wheel is rotated by an electrical motor 110 so that the holes 100A pass in front of the detector means 120B as the wheel is driven to rotate. Therefore, the signal reaching the detector means 120B moves between zero and a maximum signal level repetitively. The circuit means 90 is therefore able to determine the absolute magnitude of the incoming signal since both the zero value as well as the maximum value of the signal is continually present. Therefore, zero drift is avoided. FIG. 3B shows a preferred power supply of the invention wherein switch 40 enables electrical operation of the device.

Case 10 supports and encloses the optical collection means 30, the spectral filter means 120A, the infrared detector means 120B, and the electrical circuit means 90, as well as other components as described below. It is considered novel and of great importance to package the present invention in the manner shown in FIG. 1 because it has been discovered that such a shape, cylindrical, provides for ease of storage in a firefighter's pocket, is easily withdrawn and held in a heavy gloved hand and provides accuracy in use especially in pointing the device at a target and sweeping a wall, floor, or ceiling with the device. The use of a single operating switch, is also considered to be of great inventive value, novel and of important use in a fire-fighting environment. The single switch 40 enables all features of the device, sets automatic calibration, and provides audible feedback that all is in working order. Switch 40 is easily operated by a heavy gloved hand, provides tactile feedback and is simple to operate, being a simple, two position device. A firefighter does not have time to operate more complex controls, and is usually in a limited visibility environment, so that the present format is necessary.

A self test means 140 provides an infrared light source 140A positioned in view of the infrared detector means 120B as shown in FIG. 3A. Preferably a self test timer circuit enables the light source whenever the operation switch 40 is operated. In this case the device emits a tone to indicate that the device is fully operational. When such a tone is not heard when operating the switch 40, the specific unit is returned for repair and a different unit is used instead. This self-test function is critically important since one or mores lives may depend upon the operation of the device.

Preferably, the device further includes a downed fire fighter alarm circuit. Such an alarm circuit includes a means for sensing inertial forces, such at least one accelerometer or one liquid throw switch such as a mercury switch, and is structured to enable the audible tone of the device whenever the device is in the operational mode but is not moving. This capability is important when a firefighter is "down," i.e., unconscious within a burning building for example. Another firefighter within the sound of the tone is able therefore to locate the unconscious firefighter so as to rescue him.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A device for signaling the intensity of heat in a burning environment, the device comprising:

an optical collection means collecting, focusing and transmitting a received electromagnetic radiation signal sensed within the field of view of the device;

a spectral filter means receiving the transmitted electromagnetic radiation signal and blocking substantially all electromagnetic radiation having wavelengths shorter than about 2.6 microns and longer than about 2.8 microns, the spectral filter means transmitting that part of the electromagnetic radiation signal between about 2.6 microns and 2.8 microns;

an infrared detector means receiving the electromagnetic radiation signal from the spectral filter means and emitting an electrical detector signal when the filtered electromagnetic radiation signal is received thereon;

an operational electrical circuit means receiving and amplifying the detector signal emitted by the infrared detector means, and further, providing an audible tone, the pitch of the audible tone being proportional to the magnitude of the detector signal; and a means for interrupting the focused electromagnetic radiation signal emitted by the optical collection means, the interrupting means providing a repetitive interruption to establish a zero base for the focused electromagnetic radiation signal to overcome zero drift in the infrared detector means; and a downed-fire-fighter alarm circuit, the alarm circuit including a means for sensing inertial forces, the alarm circuit structured for enabling the audible tone of the operational electrical circuit means when the device is in an operational mode and is not moving.

2. The device of claim 1 further including a self test means, the self test means providing an infrared light source positioned in view of the infrared detector means and a self test timer circuit for enabling the light source and for producing a momentary audible signal when the operational electric circuit is fully operational.

3. The device of claim 1 wherein the inertial forces sensing means includes an accelerometer.

4. The device of claim 1 wherein the inertial forces sensing means includes a switch having a liquid electrode.

* * * * *